US012324468B1

(12) United States Patent
Vigil

(10) Patent No.: US 12,324,468 B1
(45) Date of Patent: Jun. 10, 2025

(54) EXPANDABLE HEADBAND

(71) Applicant: Yvette C. Vigil, Cedar Hill, TX (US)

(72) Inventor: Yvette C. Vigil, Cedar Hill, TX (US)

( * ) Notice: Subject to any disclaimer, the term of this patent is extended or adjusted under 35 U.S.C. 154(b) by 0 days.

(21) Appl. No.: 18/207,397

(22) Filed: Jun. 8, 2023

(51) Int. Cl.
*A41D 20/00* (2006.01)
*A42B 1/0185* (2021.01)

(52) U.S. Cl.
CPC ..... *A41D 20/00* (2013.01); *A42B 1/0185* (2021.01)

(58) Field of Classification Search
CPC ..... A41D 20/00; A42B 1/018; A42B 1/0181; A42B 1/0182; A42B 1/0184; A42B 1/0185
See application file for complete search history.

(56) References Cited

U.S. PATENT DOCUMENTS 4,393,519 A * 7/1983 Nicastro ..... A42C 5/02 D2/866
4,547,903 A * 10/1985 Brown ..... A41D 20/00 2/909
4,630,317 A * 12/1986 Brown ..... A61F 9/045 2/909
4,856,116 A * 8/1989 Sullivan ..... A61F 9/045 2/DIG. 11
5,105,475 A * 4/1992 Lynd ..... A61F 9/025 2/10
5,105,476 A * 4/1992 Cox ..... A61F 9/045 2/DIG. 11
D738,596 S * 9/2015 Tang ..... D2/876
9,861,149 B1 * 1/2018 Strollo ..... A42B 1/006
10,111,478 B2 * 10/2018 Maring ..... A41D 20/00
10,362,816 B1 * 7/2019 Vigil ..... A42B 1/206
11,957,198 B2 * 4/2024 Kim ..... A42B 1/0185
2011/0016613 A1 * 1/2011 Warrick ..... A42B 1/0184 2/209.11
2013/0139289 A1 * 6/2013 Booth Jackson ..... A61F 9/045 2/12
2015/0351966 A1 * 12/2015 McCauley ..... A61F 9/045 2/12

* cited by examiner

*Primary Examiner* — F Griffin Hall
(74) *Attorney, Agent, or Firm* — Kenneth L. Tolar

(57) ABSTRACT

An expandable headband includes a hollow annular shell constructed with an expandable but resilient fabric or similar material. The shell encapsulates an expansion mechanism that allows a user to extend a front portion of the shell to form a visor. Accordingly, the annular shell is secured around the head similarly to a conventional headband. To form a sun visor, the wearer grasps and pulls the front portion of the shell to create a cap bill that extends beyond the forehead.

4 Claims, 4 Drawing Sheets

EXPANDABLE HEADBAND

BACKGROUND OF THE INVENTION

The present invention relates to a headband that can be conveniently expanded to form a sun visor.

DESCRIPTION OF THE PRIOR ART

Many people wear a headband as a decoration or to keep hair and sweat off the face and eyes. However, in order to shield the face and eyes from direct sunlight, a wearer must replace the headband with a visor or hat having an outwardly extending brim. Transporting multiple head coverings is burdensome, inconvenient, and irritating. Furthermore, interchangeably wearing multiple head coverings increases the likelihood of losing or misplacing one or both.

Accordingly, there is currently a need for a headband that can effectively block sunlight. The present invention addresses this need by providing a headband having an internal structure that expands a front portion of the headband to form a visor if desired.

SUMMARY OF THE INVENTION

The present invention relates to an expandable headband comprising a hollow, annular shell constructed with an expandable but resilient fabric or similar material. The shell encapsulates an expansion mechanism that allows a user to extend a front portion of the shell to form a visor. Accordingly, the annular shell is secured around the head similarly to a conventional headband. To form a sun visor, the wearer grasps and pulls the front portion of the shell to create a cap bill that extends beyond the forehead.

It is therefore an object of the present invention to provide a headband that can be quickly and easily expanded to form a sun visor.

It is therefore another object of the present invention to provide an expandable headband that eliminates the burdensome task of transporting and wearing two or more head coverings while outdoors.

It is yet another object of the present invention to provide an expandable headband that resembles a conventional headband when collapsed.

Other objects, features, and advantages of the present invention will become readily apparent from the following detailed description of the preferred embodiment when considered with the attached drawings and the appended claims.

DESCRIPTION OF THE PREFERRED EMBODIMENT

Figure 2:
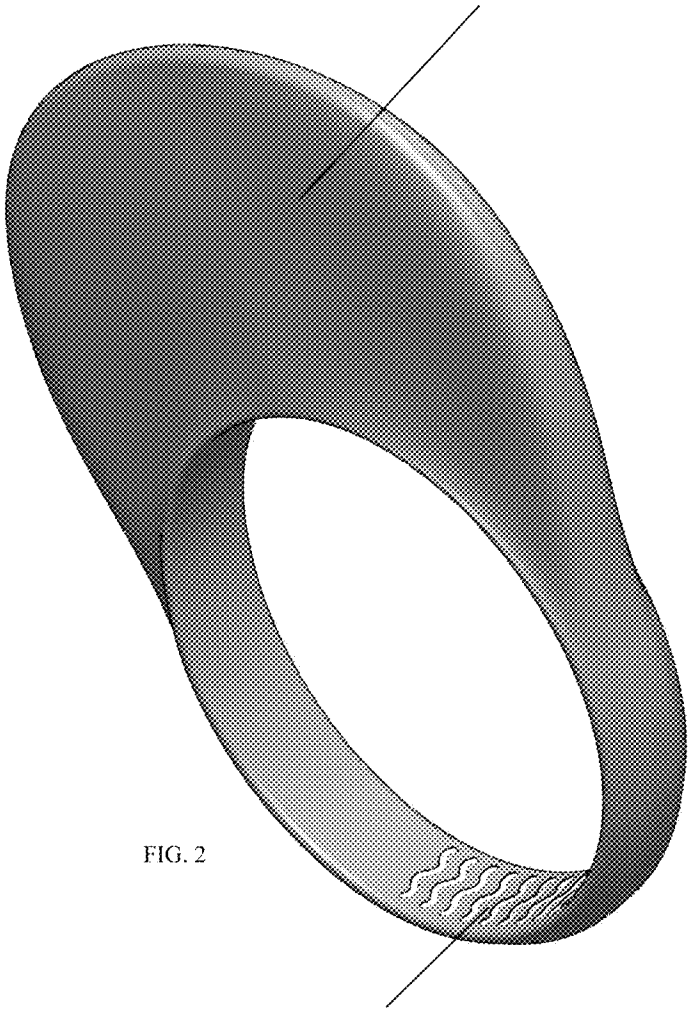
FIG. 2 depicts the headband of FIG. 1 expanded to form a visor.
Figure 1:
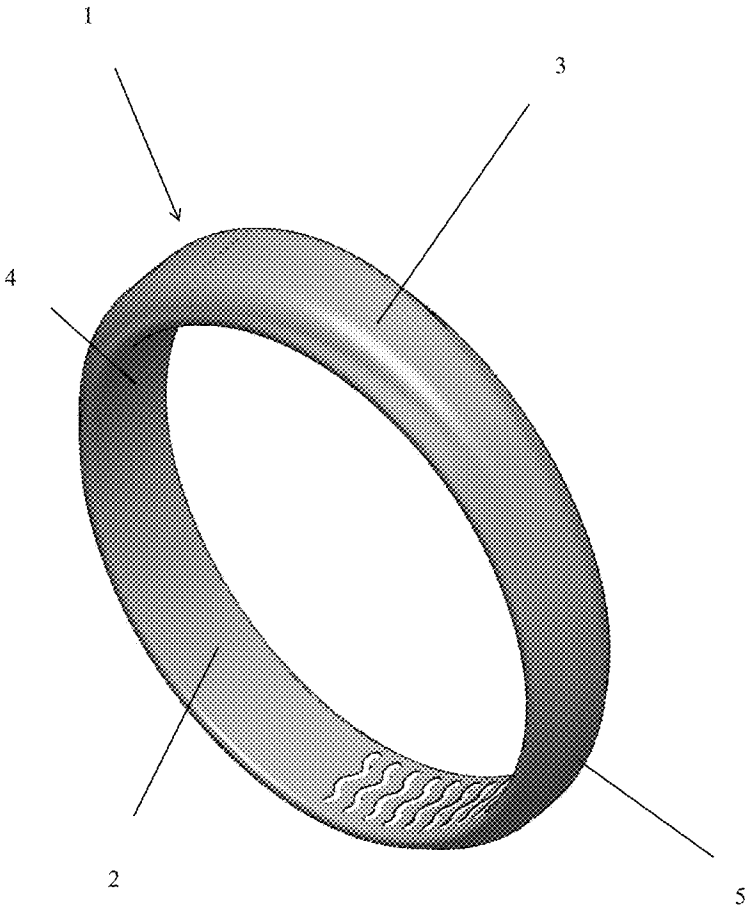
FIG. 1 depicts the headband according to the present invention present invention in a collapsed orientation.

The present invention relates to an expandable headband comprising a hollow, annular shell 1 constructed with an expandable but resilient fabric or similar material. The shell includes an inner surface 2, an outer surface 3, a front portion 4, and a rear portion 5. The inner surface of the rear portion includes strips 6 of frictional material that firmly grip the user's head or hair to prevent shifting or displacement.

The shell encapsulates an expansion mechanism 10 that allows a user to extend the front portion of the shell to form a visor. The expansion mechanism 10 includes a circular band 11 having a continuous upper edge, a continuous lower edge, an interior circumference 12, and an exterior circumference 13. Along a predetermined portion of the lower edge is a first strand 14 having a free end 15 and an inwardly turned opposing end 16. Similarly, the upper edge includes a second strand 17 extending along the same predetermined portion of the upper edge having a free end 18 and an opposing inwardly turned end 19. The inwardly turned end of each strand is immediately adjacent but spaced from the free end of the other strand to form an opening 20 therebetween.

An expansion tube 21 coils around the band with a predetermined length positioned between the first and second strands. An elastomeric strip 22 is superimposed on the strands to apply pressure to the tube. The strip and spaced threads form a passageway within which the tube slides when extending and retracting.

Figure 4:
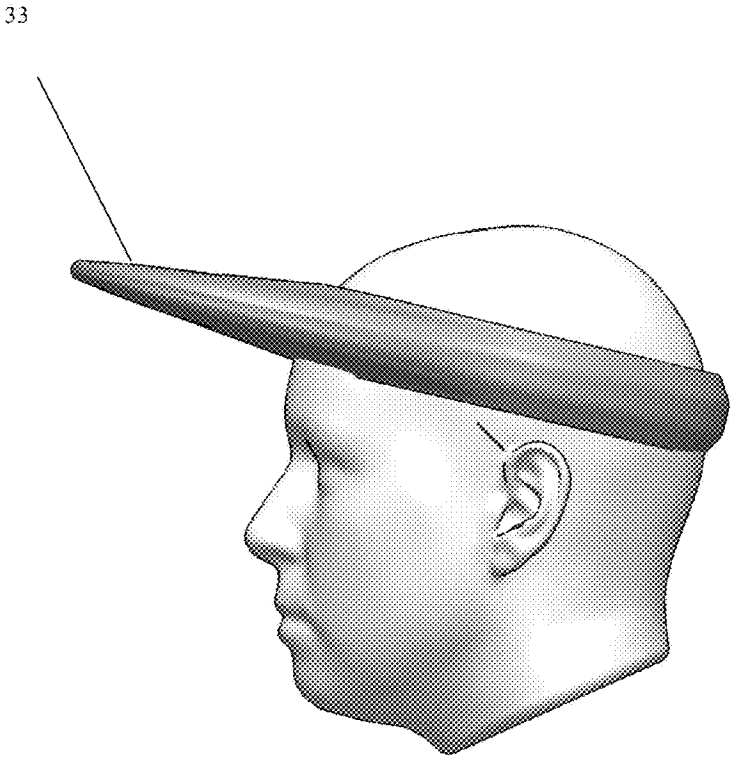
FIG. 4 depicts the device being worn as a visor.
Figure 3:
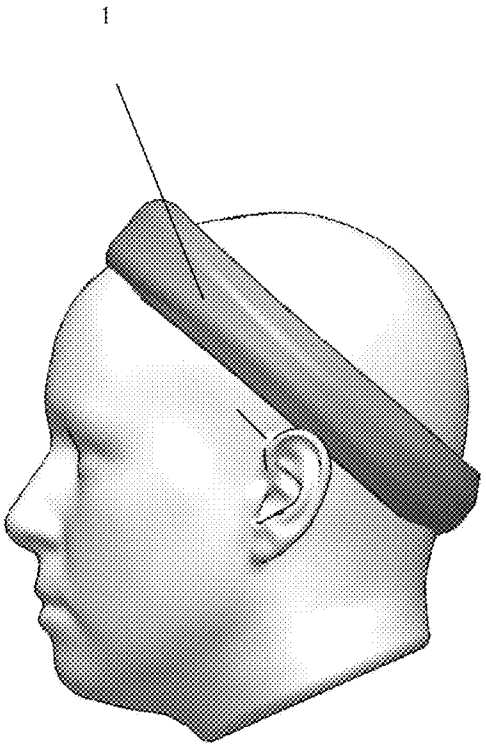
FIG. 3 depicts the device being worn as a headband.
Figure 6:
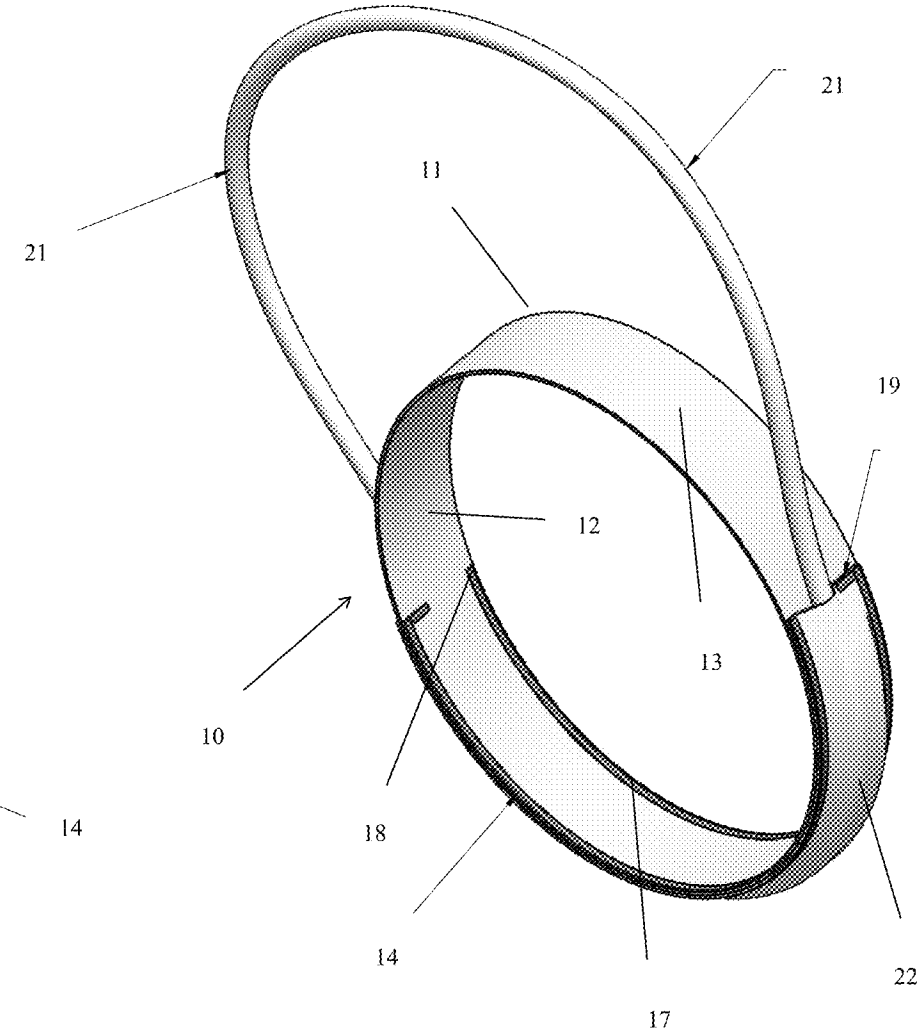
FIG. 6 is an isolated view of the expansion mechanism in an extended position.
Figure 5:
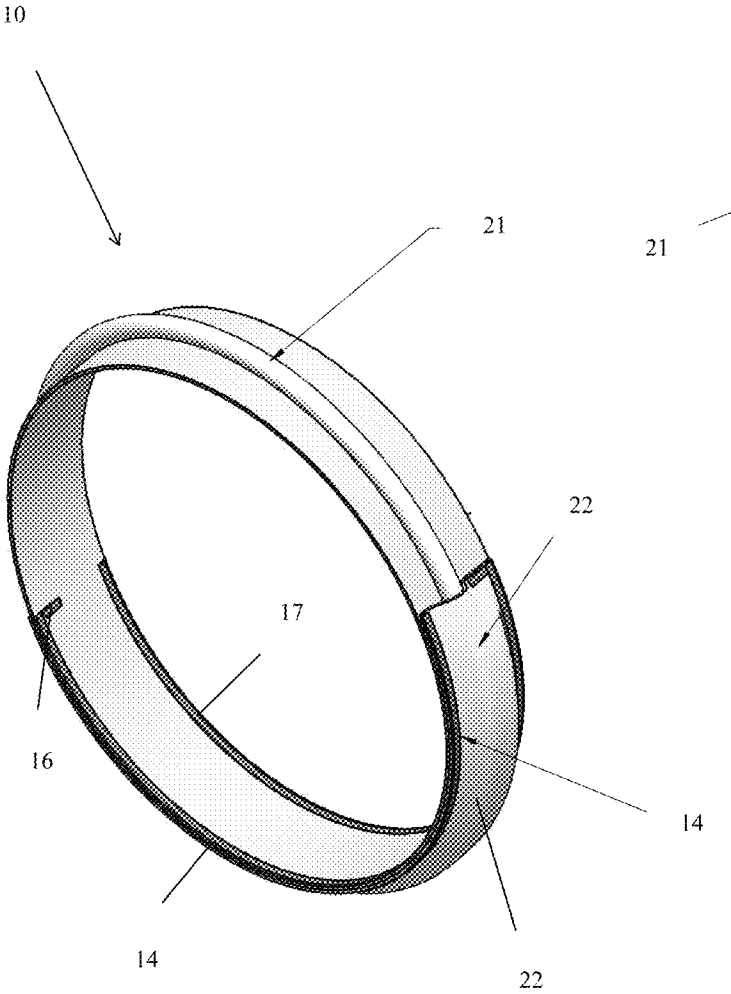
FIG. 5 is an isolated view of the expansion mechanism in a collapsed position.
Figure 8:
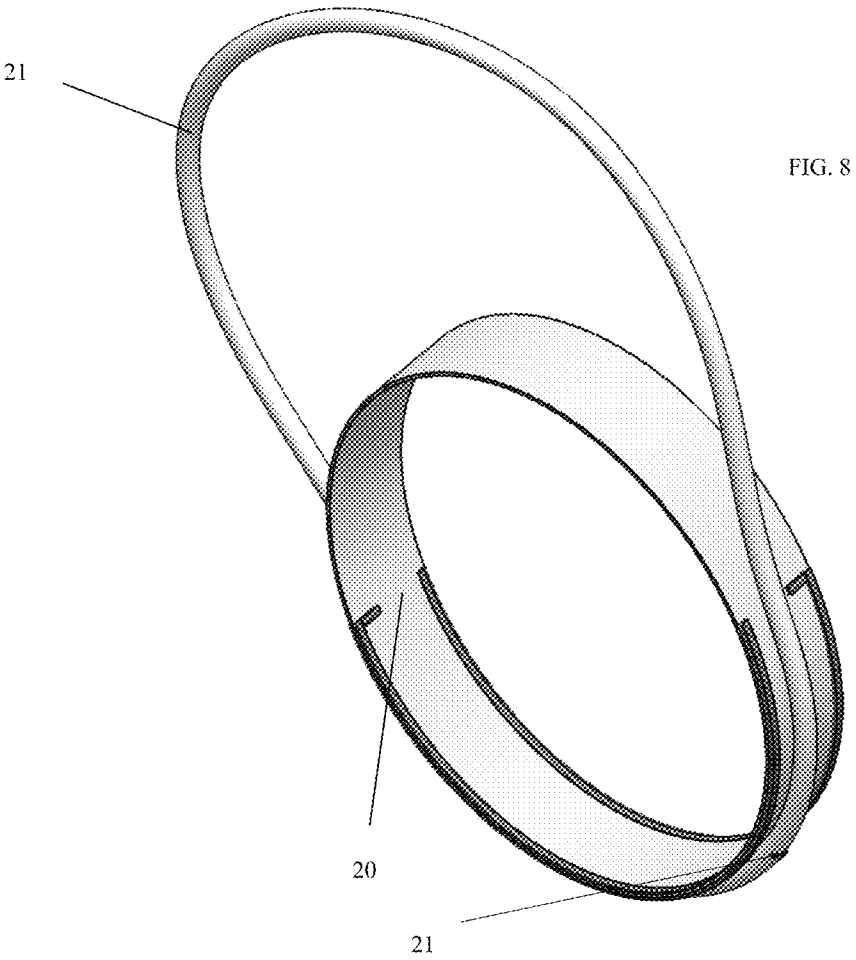
FIG. 8 is an isolated view of the expansion mechanism in an extended position with the strip removed.
Figure 7:
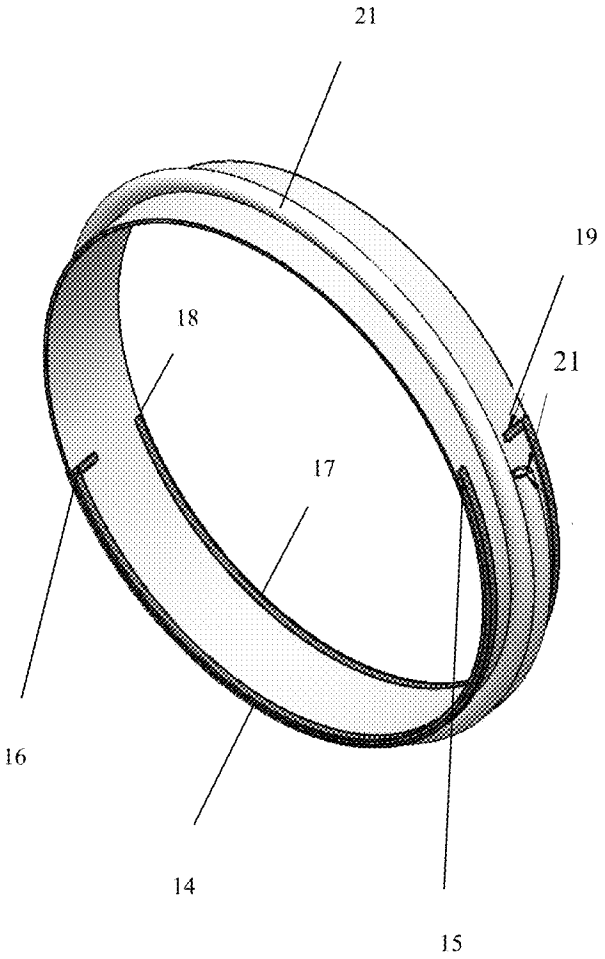
FIG. 7 is an isolated view of the expansion mechanism in a collapsed position with the strip removed.

Accordingly, the annular shell is secured around the head similarly to a conventional headband, as depicted in FIG. 3. To form a sun visor, the wearer grasps and pulls the front portion of the shell to create a cap bill 33 extending beyond the forehead, as depicted in FIG. 4. The fabric's expandable resiliency and the elastomeric strip provide enough restraint to prevent the tube from completely exiting the passageway. Moreover, when a user collapses the shell back into a headband, the tube coils around the band and overlaps itself as it is retracted within the passageway. Should the user collapse one side portion of the tube faster than the other, the inwardly turned end of one of the threads blocks the tube to allow the opposing portion to continue retracting to prevent binding or contorting.

The above-described device is not limited to the exact details of construction and enumeration of parts provided herein. Furthermore, the size, shape and materials of construction of the various components can be varied without departing from the spirit of the present invention.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. An expandable headband comprising:

a hollow, continuous annular shell constructed with a resilient but expandable material, said shell having an inner surface, an outer surface, a front portion, and a rear portion;

an expansion mechanism received within said shell that allows a user to extend the front portion of the shell to form a visor, wherein said expansion mechanism comprises:

a circular band having a continuous upper edge, a continuous lower edge, an interior circumference, and an exterior circumference;

an expansion tube coiled around said circular band;

a passageway on said band receiving a predetermined length of said expansion tube;

a first strand extending along an edge of said band, said first strand having a free end and an inwardly turned opposing end;

a second strand extending along an opposing edge of said band, said second strand having a free end and an opposing inwardly turned end, the inwardly turned end of said second strand immediately adjacent but spaced from the free end of the first strand to form an opening therebetween, and the inwardly turned end of said first strand immediately adjacent but spaced from the free end of the second strand to form a second opening therebetween.

2. The expandable headband according to claim 1 further comprising an elastomeric strip superimposed on said first strand and said second strand to apply pressure to said expansion tube.

3. The expandable headband according to claim 1 further comprising strips of frictional material on the inner surface of said shell near the rear portion that are configured to firmly grip the user's head to prevent said shell from shifting.

4. The expandable headband according to claim 1 wherein said shell is constructed with an expandable but resilient fabric.

* * * * *